United States Patent [19]

Nakayama

[11] Patent Number: 4,499,342

[45] Date of Patent: Feb. 12, 1985

[54] MULTI-POSITION ELECTRIC SWITCH

[75] Inventor: Kiyoshi Nakayama, Shizuoka, Japan

[73] Assignee: Murakami Kaimeido Co., Ltd., Shizuoka, Japan

[21] Appl. No.: 471,477

[22] Filed: Mar. 3, 1983

[30] Foreign Application Priority Data

Mar. 4, 1982 [JP] Japan ..... 57-29607[U]
May 14, 1982 [JP] Japan ..... 57-69369[U]

[51] Int. Cl.[3] ..... H01H 9/26

[52] U.S. Cl. ..... 200/5 E; 200/5 A; 200/5 R; 200/5 EA

[58] Field of Search ..... 200/5 A, 5 E, 5 R, 5 EA, 200/5 EB, 6 R, 6 A

[56] References Cited

U.S. PATENT DOCUMENTS

| | | | |
|---|---|---|---|
| 1,096,913 | 5/1914 | Hill | 200/5 E |
| 2,748,205 | 5/1956 | Forstrom | 200/50 C |
| 3,005,055 | 10/1961 | Mattke | 200/6 A |
| 3,169,174 | 2/1965 | Hut | 200/5 EB |
| 3,860,771 | 1/1975 | Lynn | 200/5 A |
| 3,898,421 | 8/1975 | Suzomura | 200/5 A |
| 4,343,973 | 8/1982 | Main | 200/5 A |
| 4,421,958 | 12/1983 | Kameda | 200/5 A |

*Primary Examiner*—E. A. Goldberg
*Assistant Examiner*—M. J. Reinhart

[57] ABSTRACT

A switch suitable for use in the remote control of electrically driven rearview mirrors of a motor vehicle. The switch is adapted to close and open a plurality of switch elements by means of a single or divided operation member. The switch occupies only a small space in an instrument panel, etc. of a motor vehicle because the switch is thin and small. Fixed contact pairs (3*a*, 4*a*) to (3*f'*, 4*f'*) forming fixed contact components are printed approximately point symmetrically around a specific center on an insulating base plate. Movable contact means is disposed on top of the fixed contact components, said movable contact means being adapted to electrically connect each of the fixed contact pairs (3*a*, 4*a*) to (3*f'*, 4') when said means is pushed. Said operation member is provided with pressing surfaces for pressing said switch elements comprising the fixed contact pairs (3*a*, 4*a*) to (3*f'*, 4') and the movable contact means, and with means for automatically returning said operation member to its original position when it is not pushed.

4 Claims, 21 Drawing Figures

MULTI-POSITION ELECTRIC SWITCH

BACKGROUND OF THE INVENTION

1. Field of the Invention

The present invention relates to a switch suitable for use in the remote control of electrically driven rearview mirrors of a motor vehicle.

2. Description of the Prior Art

Each of a pair of electrically driven rearview mirrors mounted on a door, a fender or the like, of a motor vehicle contains two electric motors, etc. in its driving section, said electric motors, etc. being controlled by means of a switch inside the vehicle so as to adjust the direction of inclination, horizontal or vertical, of each mirror. The switch for controlling the electrically driven rearview mirrors is required to have the functions of actuating each of said two electric motors of each mirror independently, and changing the polarity of electric power supply thereto. Also, the switch must be easy to fix in the instrument panel, etc.

To meet such requirements, the inventor has already invented a switch which, as disclosed in Japanese Utility Model Application No. Sho 56-71428, comprises a housing, an operation member disposed within said housing at a certain clearance from the inner walls of said housing, said operation member being adapted to swing from its neutral position in four directions meeting at right angles with one another, two switch elements disposed between said operation member and each of the four inner walls of said housing, each of said switch elements comprising a pair of sheet electrodes and a rubber sheet disposed therebetween which rubber sheet becomes conductive only when and where it is pressed (Such a rubber sheet will hereinafter be referred to as a "pressure conductive rubber sheet".), said switch elements being adapted to change the polarity of electric power supply.

However, the prior art switch has a deep shape and cannot be made small because the operation member is swingably disposed within the housing and the switch elements are disposed between the operation member and the four inner walls of the housing. Also, the switch is not very easy to fix in the instrument panel, etc. Furthermore, it does not give a good feeling of use because the operation member has almost no stroke and does not click at all.

BRIEF SUMMARY OF THE INVENTION

It is therefore an object of the invention to provide a multi-position electrical switch which has obviated all the disadvantages of the prior art.

A switch according to a first embodiment of the invention comprises a housing, an insulating base plate disposed within said housing, a plurality of fixed contact components disposed around a specific center on said insulating base plate, each of said fixed contact components consisting of a pair of printed circuit electrodes, a pressure conductive rubber sheet laid on said fixed contact components, said rubber sheet and said fixed contact components forming switch elements, a plurality of operation buttons disposed over said rubber sheet, each of said operation buttons being given a tendency to return to its original position, each of said operation buttons being provided with pressing surfaces for closing said switch elements and with an engagement piece projecting toward said specific center, a crown-shaped interceptor rotatably disposed in said specific center, said interceptor being provided at its upper side with a jagged cam surface corresponding to said engagement pieces, said jagged cam surface having teeth, the number of which is different from the number of said operation buttons, said interceptor thus being adapted to close certain switch elements when one of said operation buttons is pushed until its engagement piece enters the deepest portion of a concave on said jagged cam surface, thereby preventing other switch elements from being closed at the same time.

A switch according to a second embodiment of the invention comprises a housing, an insulating base plate disposed within said housing, a plurality of fixed contact components which are the same as in the first embodiment, an insulating sheet laid on top of said insulating base plate, said insulating sheet being provided in positions corresponding to the positions of said fixed contact components with cup-shaped elastic portions opening toward said fixed contact components, said elastic portions being respectively provided inside their top with movable contacts, an inclinable operation button having pressing surfaces for closing said switch elements when said operation button is inclined, said operation button being provided in said specific center and in positions corresponding to areas between said elastic portions with projections for preventing the simultaneous closing of said switch elements.

The above-mentioned construction ensures a flat, thin and small switch which can be easily fixed in a relatively small space such as an instrument panel of a motor vehicle. Therefore, the switch according to any of the two embodiments is very suitable for use in the control of rearview mirrors of a motor vehicle.

In addition to the aforesaid common advantages, each of the two embodiments has its own advantages as follows:

According to the first embodiment in which the switch comprises a plurality of operation buttons and an interceptor in the specific center for preventing the simultaneous closing of the switch elements, when the switch is used for controlling the rearview mirrors of a motor vehicle each of the independent operation buttons definitely corresponds to each of the directions (up, down, right and left) in which the angle of the rearview mirrors is adjusted. Therefore, the switch is easy to use and gives a good feeling of use.

According to the second embodiment in which the switch comprises cup-shaped elastic portions disposed over the fixed contact components, said elastic portions being respectively provided inside with movable contacts, and an inclinable operation button having projections for preventing the simultaneous closing of the switch elements, the operation button is inclined against the elastic force of the elastic portions and is returned to its original position thereby. Therefore, the operation button gives a more constant feeling of use and ensures smooth operation even after it is used for a long period of time. Also, the switch is inexpensive because the movable contacts do not have to be made of expensive pressure conductive rubber and even when they are they can be made smaller.

DESCRIPTION OF THE DRAWINGS

FIG. 1 is a plan view of a switch.

FIG. 2 is a sectional view taken on line II—II of FIG. 1.

FIG. 3 is a bottom view of a housing.

FIG. 4 is a plan view of a supporting plate seen in FIG. 2.

FIG. 5 is a plan view of an operation button.

FIG. 6 is a view taken in the direction of the arrow Y in FIG. 5.

FIG. 7 is a bottom view of said operation button.

FIG. 8 is an enlarged perspective view of an interceptor seen in FIG. 2.

FIG. 9 is a plan view of said interceptor.

FIG. 10 is a development of the side of said interceptor and also illustrates engagement pieces.

FIG. 11 is a sectional view taken on line XI—XI of FIG. 1.

FIG. 12 is a bottom view of a slide block seen in FIG. 11.

FIG. 13 is an enlarged plan view of an insulating base plate seen in FIG. 2.

FIG. 14 is a plan view schematically illustrating the arrangement of switch elements on said insulating base plate.

FIG. 15 is a circuit diagram showing connections between switch elements, etc.

FIG. 16 is a plan view of a switch.

FIG. 17 is an enlarged sectional view taken on line XVII—XVII of FIG. 16.

FIG. 18 is a bottom view of an insulating sheet.

FIG. 19 is a bottom view of an operation button.

FIG. 20 is an enlarged plan view of an insulating base plate.

FIG. 21 is a plan view schematically illustrating the arrangement of switch elements on said insulating base plate.

DETAILED DESCRIPTION OF THE PREFERRED EMBODIMENTS

The present invention will now be described in detail, with reference to a first embodiment illustrated in FIGS. 1 to 15 in which the invention is applied to a switch for controlling electrically driven rearview mirrors of a motor vehicle.

Numeral 1 represents a housing. Numeral 2 represents an insulating base plate of a printed circuit, which plate also serves as a bottom plate of the housing 1. Disposed within the housing 1 are a switch S1 for changing the polarity of electric power supply and another switch S2 for the changeover between a right-hand mirror R and a left-hand mirror L.

Figure 15:
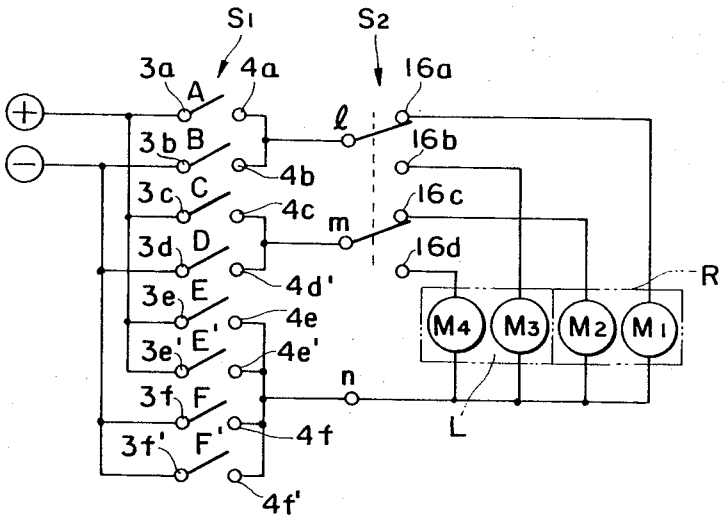

First, the switch S1 will be described in detail. The switch S1 comprises, for example, eight switch elements A to F′ as shown in FIG. 15. Eight pairs of printed circuit electrodes 3*a* and 4*a* to 3*f′* and 4*f′*, serving as fixed contact components of the switch elements A to F′, are printed around a specific center 7 on the base plate 2 so that each pair of electrodes are engaged with each other like a pair of combs. The whole printed circuit electrodes 3*a* and 4*a* to 3*f′* and 4*f′* cover an approximately square area around the specific center 7 on the base plate 2. See FIG. 13.

A pressure conductive rubber sheet 5, corresponding to a movable contact of a conventional switch element, is laid on said fixed contact components. The single rubber sheet 5 is common to all the fixed contact components. The pressure conductive rubber sheet 5 is made of silicone rubber and metal particles, for example. It is usually nonconductive and becomes conductive according to the pressure applied thereto.

Figure 14:
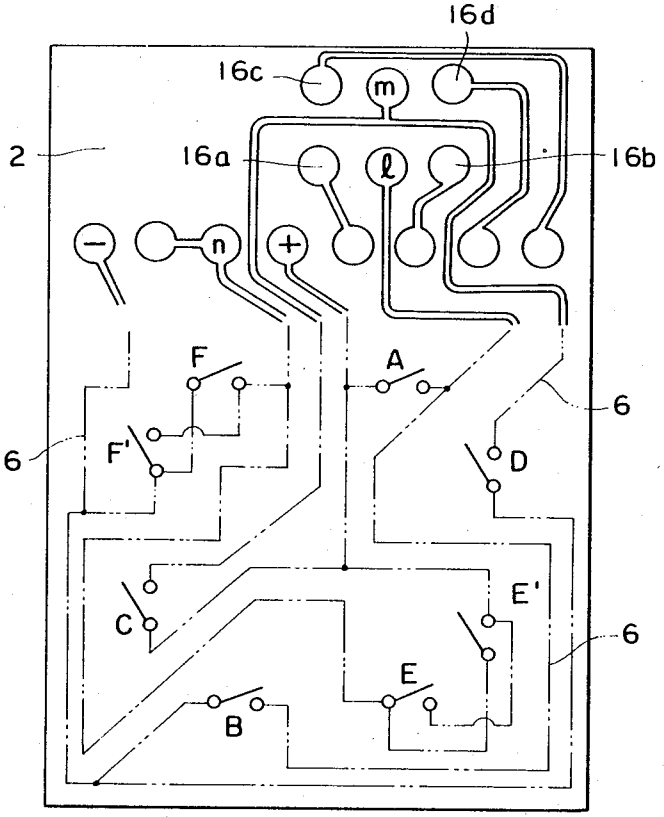
Figure 16:
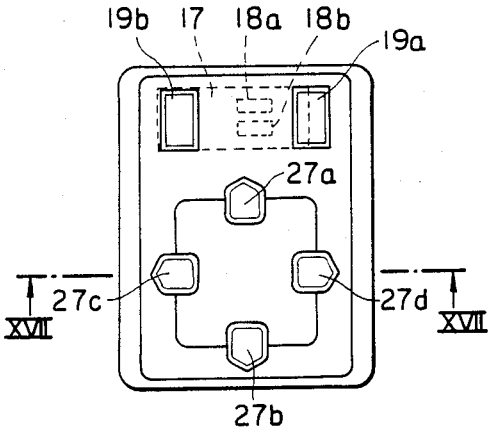
FIGS. 16 to 21 illustrate a second embodiment of the invention.

Thus, according to the present invention, the eight switch elements A to F′ are disposed on the surface of the base plate 2 and they are connected by printed conductors 6 so as to form two switch means for changing the polarity of electric power supply. That is, in FIG. 15, the four switch elements A, B, E and F form one switch means (switch means for vertical adjustment) and the four switch elements C, D, E′ and F′ form the other switch means (switch means for horizontal adjustment). The arrangement of the switch elements A to F′ on the base plate 2 is illustrated in FIG. 14.

Driving means as follows are disposed over said switch elements A to F′.

Figure 3:
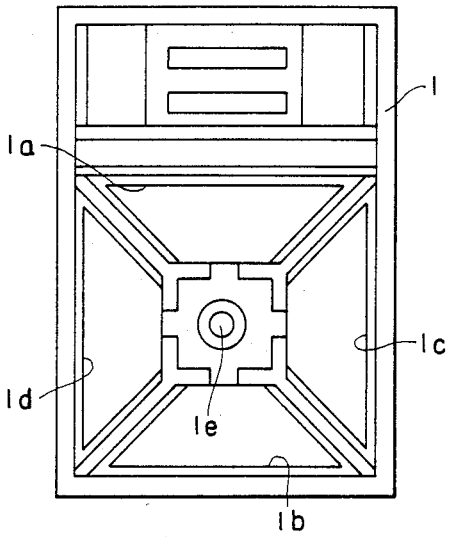
Figure 4:
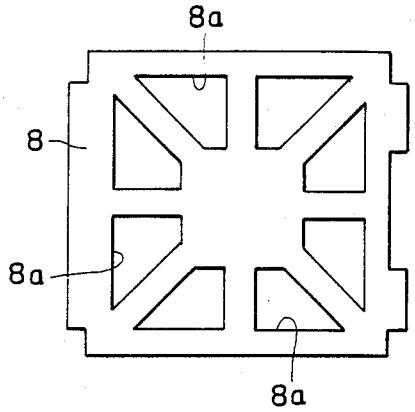
Figure 5:
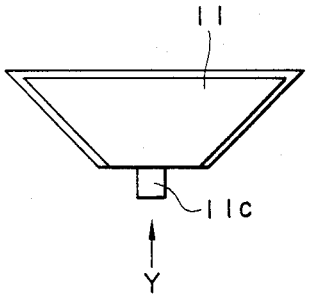
Figure 6:
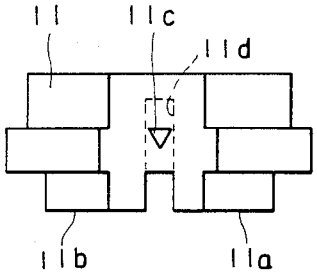
Figure 7:
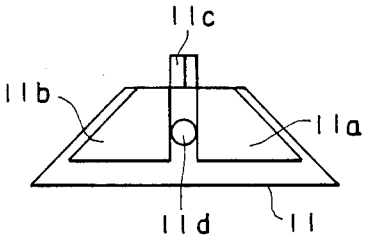

First, a supporting plate 8 as shown in FIG. 4 is disposed on top of the rubber sheet 5. The supporting plate 8 is fixed at its periphery to the housing 1. The supporting plate 8 is provided at its portions corresponding to the positions of said switch elements A to F′ with openings 8*a* into which pressing surfaces (described later) are loosely inserted. The housing 1 is provided at its portion corresponding to said specific center 7 on the inside with a projecting axial pin 1*e* as shown in FIG. 3, said housing 1 further having four trapezoid openings 1*a* to 1*d* disposed with the axial pin 1*e* as the center of symmetry. Operation buttons 11 to 14 are respectively inserted into the trapezoid openings 1*a* to 1*d* so that each of the operation buttons can be pushed in and automatically returns to its original position. Each of the operation buttons 11 to 14 is provided on its side facing the rubber sheet S with two pressing surfaces which project slightly. FIGS. 6 and 7 show two pressing surfaces 11*a* and 11*b* of the operation button 11 by way of example. The pressing surface 11*a* corresponds to the switch element A, while the other pressing surface 11*b* corresponds to the switch element F. The operation button 11 is provided with an engagement piece 11*c* projecting toward the axial pin 1*e*, said engagement piece 11*c* having a triangular section with its vertex facing downward (toward the rubber sheet 5). The operation button 11 further has a spring hole 11*d* between the two pressing surfaces 11*a* and 11*b*. A coiled spring 10 is disposed within the spring hole 11*a* and is compressed between the operation button 11 and the supporting plate 8 so as to give the operation button 11 a tendency to return to its original position. Usually the pressing surfaces 11*a* and 11*b* of the operation button 11 are partially inserted into the openings 8*a* of the supporting plates 8 so that the pressing surfaces 11*a* and 11*b* are surely guided by the openings 8*a* when the operation button 11 is pushed.

The construction and arrangement of the other operation buttons 12 to 14 are the same as mentioned above. The operation button 12 corresponds to the switch elements B and E. The operation button 13 corresponds to the switch elements F′ and C. The operation button 14 corresponds to the switch elements D and E′. In this way, each of the operation buttons 11 to 14 corresponds to two switch elements.

Figure 8:
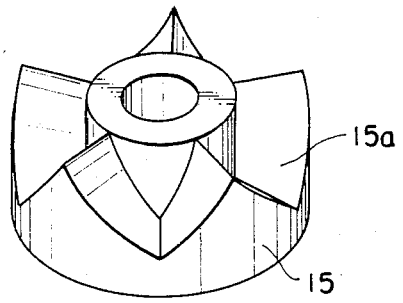
Figure 9:
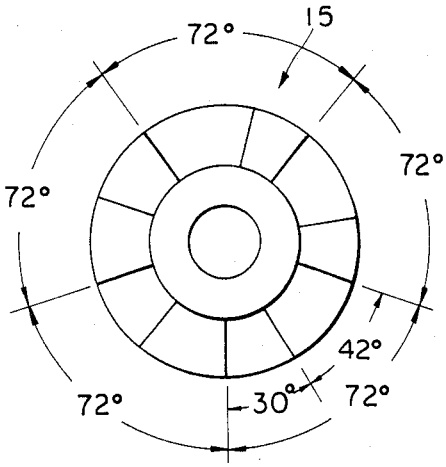
Figure 10:
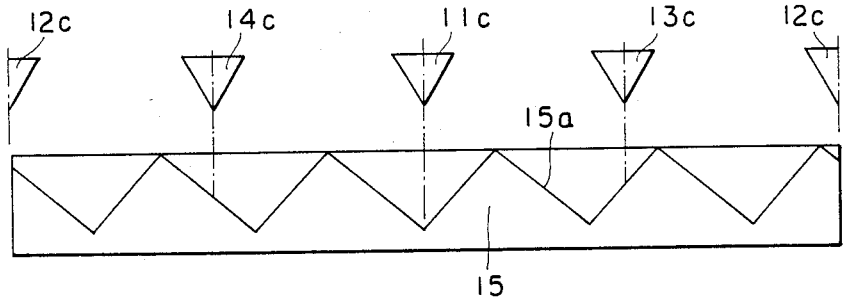

A crown-shaped interceptor 15 having a jagged cam surface 15*a* corresponding to the engagement pieces 11*c* to 14*c* is rotatably attached to the axial pin 1*e* in the specific center 7. As shown in FIGS. 8 to 10, the jagged cam surface 15*a* has teeth, the number of which is different from the number (four) of the operation buttons 11 to 14, that is, the number (four) of the engagement pieces 11*c* to 14*c*. The number of the teeth of the jagged cam surface 15*a* is five in the illustrated example, but it is not restricted thereto and may be three, seven, nine or any other number provided that the difference between the number of the teeth and the number of the operation buttons is an odd number. Each of the teeth of the jagged cam surface has a shape resembling a saw tooth, and is not symmetrical. That is, portions on both sides of a point are not the same in shape. In a plan view of FIG. 9, each of the teeth occupies an opening angle of 72°, and a portion thereof on one side of the point occupies an opening angle of 30° while a portion thereof on the other side of the point occupies an opening angle of 42°.

As shown in FIG. 10, when one engagement piece 11*c* is in a position corresponding to the deepest portion of a concave, the other engagement pieces 12*c* to 14*c* are in positions corresponding to other portions of respective concaves. When any one of the engagement pieces 11*c* to 14*c* is pushed into the deepest portion of a concave, only two switch elements corresponding to the operation button pushed are exclusively closed, so that other switch elements are prevented from being closed at the same time.

Figure 11:
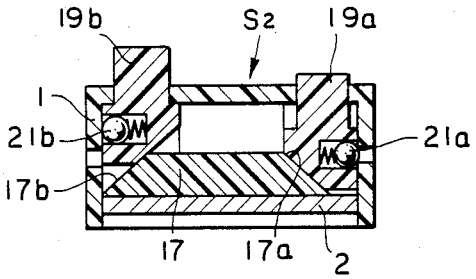
Figure 12:
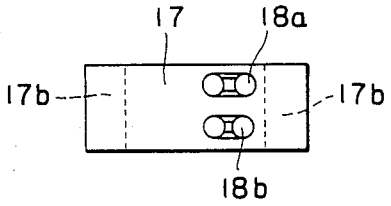
Figure 13:
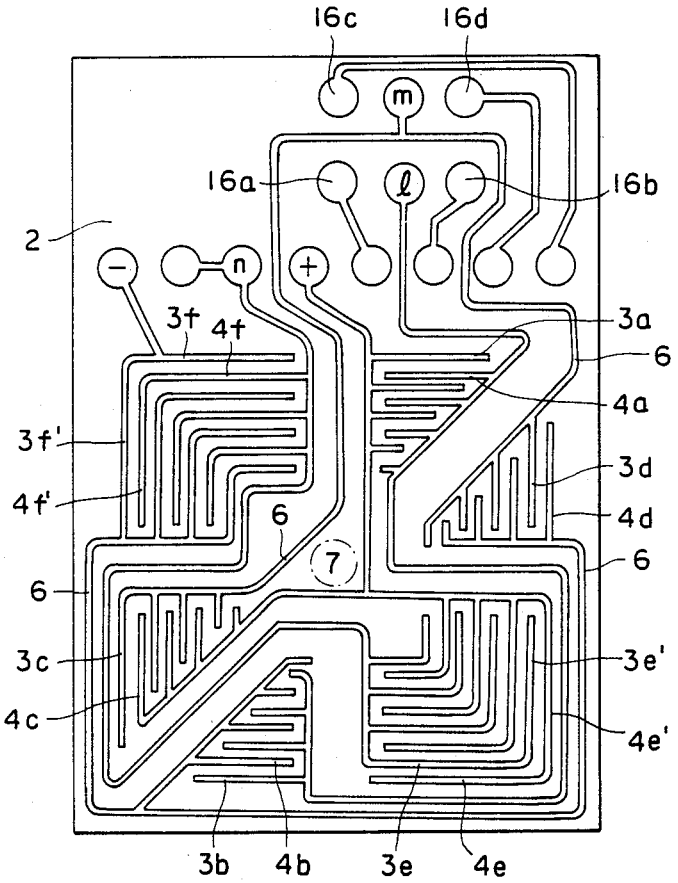

Reference will now be made to the switch S2 for selectively connecting the above-mentioned switch S1 with either the right-hand mirror R or the left-hand mirror L. The switch S2 comprises two circuits and six contacts. Contact patterns l, m and 16*a* to 16*d*, corresponding to the six contacts, are printed near one end (upper portion in FIG. 13) of the base plate 2. A slide block 17, slidable right and left in FIG. 11 or 12, is disposed over the contact patterns l, m and 16*a* to 16*d*. The slide block 17 is provided with movable contacts 18*a* and 18*b* corresponding to the contact patterns l, m and 16*a* to 16*d*. A pair of push buttons 19*a* and 19*b* respectively corresponding to the right-hand mirror R and the left-hand mirror L are disposed on both sides of the slide block 17 in the direction of its slide. The driving end of each push button is engaged with each of taper portions 17*a* and 17*b* formed on both ends of the slide block 17. Numerals 21*a* and 21*b* represent balls for positioning the push buttons 19*a* and 19*b*.

Thus, the embodiment illustrated in FIGS. 1 to 15 is a hybrid switch comprising said switch S1 including the eight switch elements A to F′ and said changeover switch S2.

Figure 1:
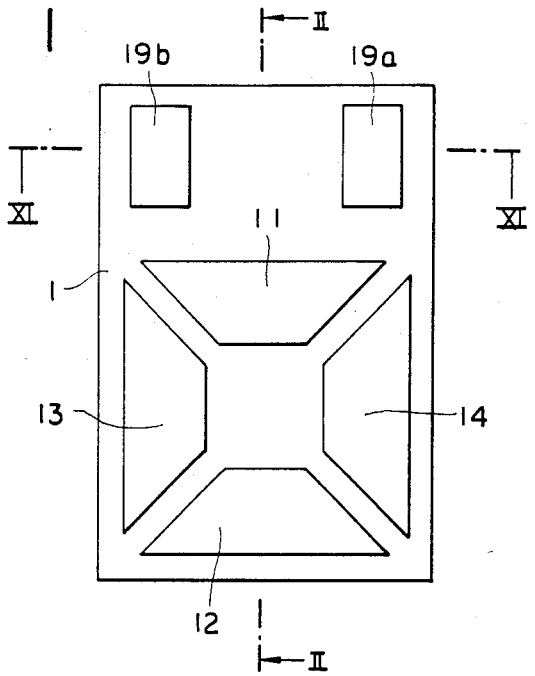
FIGS. 1 to 15 illustrate a first embodiment of the invention.
Figure 2:
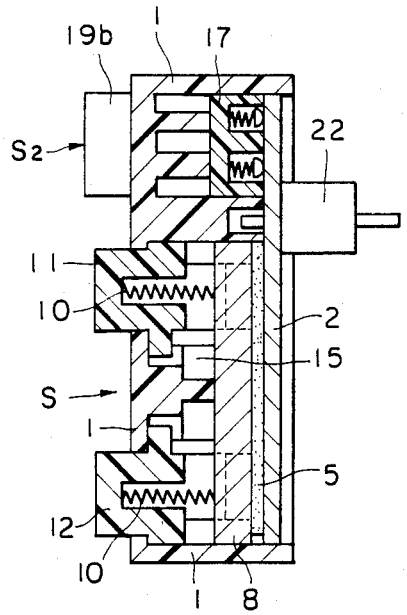

Numeral 22 in FIG. 2 represents a connector for connecting the contacts l, m and 16*a* to 16*d* in the changeover switch S2 with the rearview mirrors R and L. Referring to FIG. 15, symbol M1 represents an electric motor for vertically adjusting the right-hand mirror R, symbol M2 representing an electric motor for horizontally adjusting the right-hand mirror R, symbol M3 representing an electric motor for vertically adjusting the left-hand mirror L, and symbol M4 representing an electric motor for horizontally adjusting the left-hand mirror L.

The operation of the switch of the first embodiment will now be described.

Reference will be made to the case of controlling the right-hand mirror R by pushing the push button 19*a* of the changeover switch S2. When the push button 19*a* is pushed, the slide block 17 is slid toward the left in FIG. 11 and its movable contacts 18*a* and 18*b* respectively close the contacts l and 16*a* together and the contacts m and 16*c* together so that the switch S1 is connected with the right-hand mirror R. (See FIG. 15.)

When the operation button 11 is pushed thereafter, the engagement piece 11*c* of the operation button 11 enters the deepest portion of a concave on the jagged cam surface 15*a* (See FIG. 10.) and the switch elements A and F are closed. Then, the electric motor M1 rotates in such a direction as changes the angle of the right-hand mirror R upward. Even if any of the other operation buttons 12 to 14 is pushed at this time, the engagement piece thereof is not allowed to enter the deepest portion of a concave on the jagged cam surface 15*a* and therefore no other switch elements are closed.

When only the operation button 12 is pushed, the engagement piece 12*c* thereof contacts the jagged cam surface 15*a* and turns the interceptor 15 until it enters the deepest portion of a concave on the jagged cam surface 15*a*. As a result, the switch elements B and E are closed and the electric motor M1 rotates in a reversed direction so as to change the angle of the right-hand mirror R downward.

When only the operation button 13 is pushed, the engagement piece 13*c* thereof behaves in the same way as mentioned above. Then the switch elements C and F′ are closed and the electric motor M2 rotates in such a direction as changes the angle of the right-hand mirror R toward the left.

When only the operation button 14 is pushed, the switch elements D and E′ are closed in the same way as mentioned above. Then, the electric motor M2 rotates in a reversed direction so as to change the angle of the right-hand mirror R toward the right.

When the push button 19*b* of the changeover switch S2 is pushed, the left-hand mirror L is controlled in the same way as described above.

FIGS. 16 to 21 illustrate a second embodiment of the present invention. The second embodiment is different from the aforesaid first embodiment mainly in the construction of movable contacts in switch elements. In the second embodiment, cup-shaped elastic portions are provided over fixed contact components and a movable contact is fixed inside the top of each of the elastic portions. Therefore, the movable contacts may be made of a metal unlike in the first embodiment. Connections between the switch elements are much the same as in the first embodiment.

The second embodiment will now be described in detail with respect to the differences from the first embodiment. An insulating sheet 24 is laid on top of an insulating base plate 2 of a printed circuit. The insulating sheet 24 has cup-shaped elastic portions 25*a* to 25*h* corresponding to a plurality of fixed contact components. The elastic portions 25*a* to 25*h* may be made of rubber integrally with the insulating sheet 24, or they may be made of a different insulating material separately from the insulating sheet 24. Movable contacts 26*a* to 26*h* are fixed inside the top of the elastic portions 25*a* to 25*h*. The movable contacts 26*a* to 26*h* may be made of pressure conductive rubber consisting of silicone rubber and metal particles, or they may be metal plates, etc.

Figure 21:
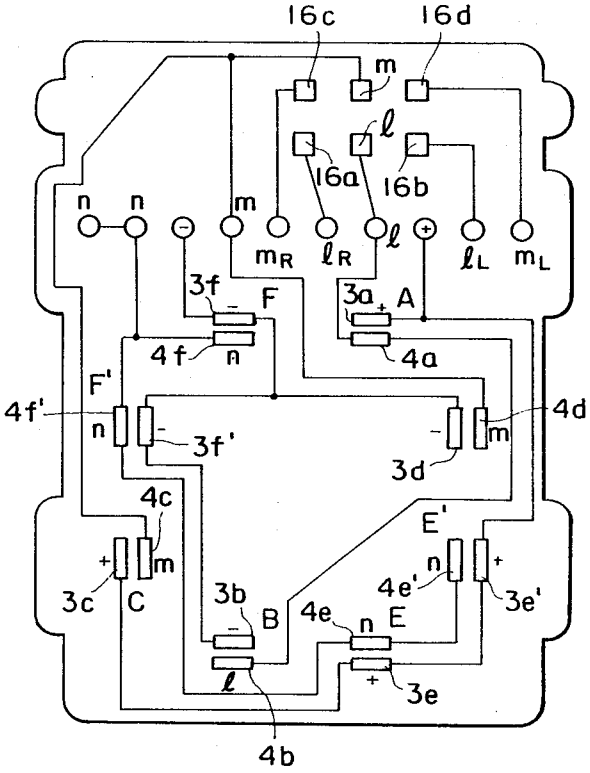
Figure 20:
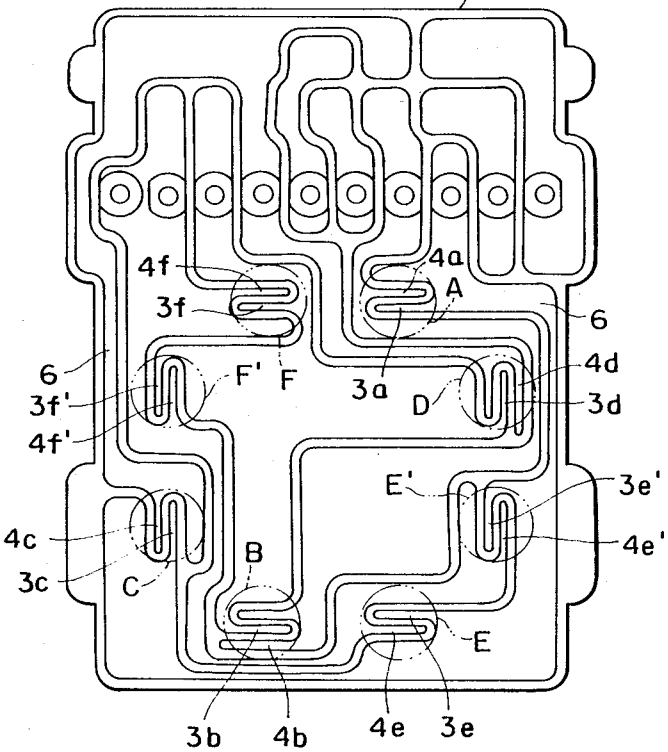

Eight switch elements A to F′ are thus formed on the base plate 2, and they are connected by means of printed conductors 6 so as to form two switch means for changing the polarity of electric power supply. The arrangement and connection of fixed contact components on the base plate 2 are much the same as in the first embodiment as shown in FIGS. 20 and 21.

Driving means as follows are disposed over said switch elements A to F′.

Figure 19:
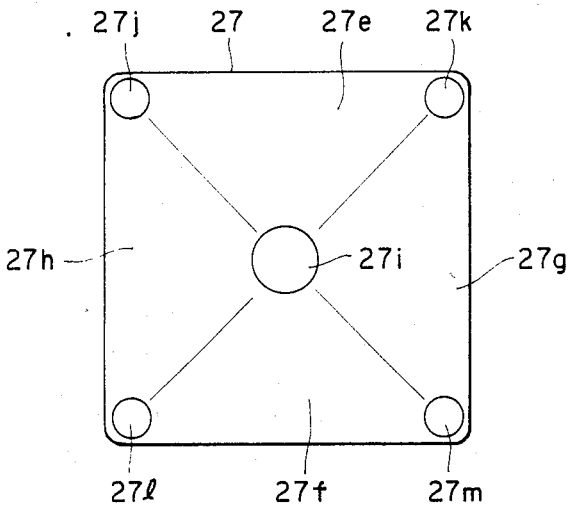

An inclinable operation button 27 is disposed over the eight elastic portions 25*a* to 25*h* of the insulating sheet 24. The operation button 27 is square in its plan view, and the outside of its top is engaged with the corners between the inner walls of a housing 1 and the top plate thereof. Projecting push buttons 27*a* to 27*d* provided on the top of the operation button 27 protrude upward from openings 1*f* provided in the top plate of the housing 1. As shown in FIG. 19, the operation button 27 is provided at its bottom with four pressing surfaces 27*e* to 27*h* so divided by two diagonal lines, said pressing surfaces respectively lying on top of two elastic portions 25*a* and 25*b*, 25*c* and 25*d*, 25*e* and 25*f*, and 25*g* and 25*h*. Therefore, the pressing surface 27*e* corresponds to the switch elements A and F, the pressing surface 27*f* corresponding to the switch elements B and E, the pressing surface 27*g* corresponding to the switch elements C and F′, the pressing surface 27*h* corresponding to the switch elements D and E′. Thus, each pressing surface of the operation button 27 corresponds to two switch elements.

The operation button 27 is provided in the center and four corners of its bottom with projections 27*i* and 27*j* to 27*m* for preventing the simultaneous operation of more than one pressing surface thereof. If two push buttons, for example 27*a* and 27*c* or 27*a* and 27*d*, are pushed with the same force at the same time, the projection 27*i* passes through an opening 24*a* in the center of the insulating sheet 24 and contacts the base plate 2 while one of the projections 27*j* to 27*m* passes through one of notches 24*b* at the four corners of the insulating sheet 24 and contacts the base plate 2, so that switch elements corresponding to two pressing surfaces, for example F and F′, A and D or F and E′, are not closed at the same time, thus the possibility of the oblique movement of the mirror or short circuit being eliminated. Therefore, the lengths of the projections 27*i* and 27*j* to 27*m* are such that the projections are out of contact with the base plate 2 when one of the push buttons 27*a* to 27*d* is properly pushed and corresponding switch elements are closed while the projections come into contact with the base plate 2 so as to prevent any switch elements from being closed when a plurality of push buttons are pushed at the same time.

The construction of a changeover switch S2, etc. is substantially the same as in the first embodiment.

Figure 17:
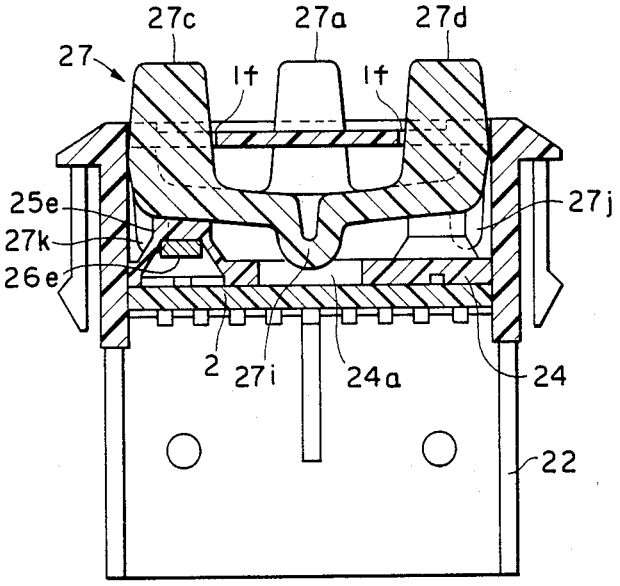
Figure 18:
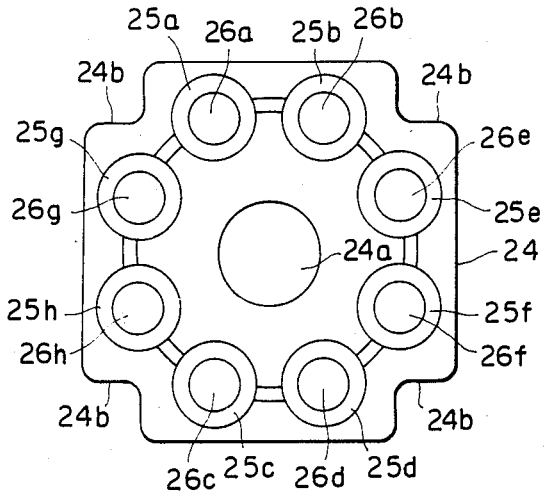

The operation of the second embodiment will now be described. The right-hand mirror R is controlled as follows: When the push button 19*a* of the switch S2 and then the position 27*a* of the operation button 27 are pushed, the elastic portions 25*a* and 25*b* of the insulating sheet 24 are contracted so as to bring the movable contacts 26*a* and 26*b* into contact with the fixed contact components 3*f*, 4*f* and 3*a*, 4*a*. Then, the switch elements A and F are closed and the electric motor M1 rotates in such a direction as changes the angle of the right-hand mirror R upward. When the operation button 27 is released thereafter, the operation button 27 returns to its neutral position as shown in FIG. 17 by the elasticity of the elastic portions 25*a* and 25*b*. Such elastic action of the elastic portions 25*a* and 25*b* gives a good feeling of clicking.

When the position 27*b* of the operation button 27 is pushed, the switch elements B and E are closed and the electric motor M1 rotates in a reversed direction so as to change the angle of the right-hand mirror R downward.

When the position 27*c* of the operation button 27 is pushed, the switch elements C and F′ are closed and the electric motor M2 rotates in such a direction as changes the angle of the right-hand mirror R toward the left.

When the position 27*d* of the operation button 27 is pushed, the switch elements D and E′ are closed and the electric motor M2 rotates in a reversed direction so as to change the angle of the right-hand mirror R toward the right.

When the position 27*b*, 27*c* or 27*d* is pushed, the elastic portions 25*c* and 25*d*, 25*g* and 25*h*, or 25*e* and 25*f* behave in the same way as when the position 27*a* is pushed.

When the push button 19*b* of the changeover switch S2 is pushed, the left-hand mirror L is controlled in the same way as described above.

As many apparently widely different embodiments of this invention may be made without departing from the spirit and scope thereof, it is to be understood that the invention is not limited to the specific embodiments thereof except as defined in the appended claims.

What is claimed is:

1. A multi-position electrical switch comprising
a housing,
an insulating base disposed within said housing,
a plurality of fixed contact components disposed around a specific center on said insulating base plate, each of said fixed contact components consisting of a pair of printed circuit electrodes,
a rubber sheet which becomes conductive only when and where it is pressed, said rubber sheet being laid on said fixed contact components, said rubber sheet and said fixed contact components forming switch elements,
a plurality of operation buttons disposed over said rubber sheet, each of said operation buttons being given a tendency to return to its original position, each of said operation buttons being provided with pressing surfaces for closing said switch elements and being provided with an engagement piece of triangular cross-section projecting toward said specific center.
an axial pin disposed in said specific center, and
a crown-shaped interceptor rotably mounted on said axial pin, said interceptor being provided on its upper side with a jagged cam surface for engaging said engagement pieces, said jagged cam surface comprising a series of non-symmetrical teeth, the number of said teeth differing from the number of said operation buttons by an odd number, said interceptor thus being adapted to rotate when the side of one of said teeth is contacted by the engagement piece of one of said operation buttons as said operation button is depressed, allowing said engagement piece to enter the lowest point between two of said teeth, permitting certain switch elements to be closed by said depressed operation button thereby preventing the remaining operation buttons from closing other switch elements.

2. A switch as claimed in claim 1, comprising four operation buttons, eight switch elements, two each of which correspond to each of said operation buttons, said switch elements forming two switch means for changing the polarity of electric power supply.

3. A multi-position electrical switch comprising
a housing,
an insulating base plate disposed within said housing, a plurality of fixed contact components disposed around a specific center on said insulating base plate, each of said fixed contact components consisting of a pair of printed circuit electrodes, an insulating sheet laid on top of said insulating base plate, said insulating sheet being provided in positions corresponding to the positions of said fixed contact components with cup-shaped elastic portions opening toward said fixed contact components, said elastic portions being respectively provided inside their top with movable contacts, said movable contacts and said fixed contact components forming switch elements, and an inclinable operation button having pressing surfaces for closing switch elements when said operation button is inclined, said operation button contacting the respective inner wall of said housing when inclined, said operation button being provided with a plurality of push buttons to effect the inclination thereof, and with a projection at the bottom center thereof, said insulating sheet being provided with a center opening corresponding to said projection, whereby said projection contacts said base plate and prevents closing of any of said switch elements in the event a plurality of push buttons is pressed at the same time.

4. A switch as claimed in claim 3, wherein said operation button has four pressing surfaces, each of which corresponds to two of eight switch elements, said switch elements forming two switch means for changing the polarity of electric power supply.

* * * * *